US006797011B2

(12) United States Patent
Blangiforti

(10) Patent No.: US 6,797,011 B2
(45) Date of Patent: Sep. 28, 2004

(54) LEATHER THERAPY TREATMENT

(76) Inventor: Anna Carner Blangiforti, 2 Wildwood Rd., Califon, NJ (US) 07830

( * ) Notice: Subject to any disclaimer, the term of this patent is extended or adjusted under 35 U.S.C. 154(b) by 106 days.

(21) Appl. No.: 10/310,128

(22) Filed: Dec. 5, 2002

(65) Prior Publication Data

US 2004/0107504 A1 Jun. 10, 2004

(51) Int. Cl.[7] ..... D06L 1/16; D06L 1/22; C11D 1/37; C11D 1/83

(52) U.S. Cl. ..... 8/137; 8/94.1 D; 510/292; 510/340; 510/351; 510/352; 510/353; 510/355; 510/356; 510/357; 510/358

(58) Field of Search ..... 8/137, 94.1 D; 510/292, 340, 351–358

(56) References Cited

U.S. PATENT DOCUMENTS 3,850,834 A * 11/1974 Hellsten et al. ..... 510/448
3,892,681 A * 7/1975 Edwards et al. ..... 510/327
3,920,565 A * 11/1975 Morton ..... 510/524
4,194,986 A * 3/1980 Tournier et al. ..... 510/316
4,532,719 A * 8/1985 Davies et al. ..... 34/389

FOREIGN PATENT DOCUMENTS

DE 4216187 * 5/1992

* cited by examiner

*Primary Examiner*—Margaret Einsmann
(74) *Attorney, Agent, or Firm*—Thomas A. Beck

(57) ABSTRACT

Compositions which are used directly in the conventional home laundry machine to clean and renourish articles made from leather, textile and synthetic leather. Specifically, two separate compositions are used during a typical washing cycle in the home washing machine. First, the leather laundry solution is added during the "wash cycle." Subsequently a laundry rinse and dressing composition is added to the finishing rinse cycle of the washing machine. The composition may also be used as a wipe-on application after laundering.

14 Claims, No Drawings

LEATHER THERAPY TREATMENT

BACKGROUND OF THE INVENTION

1. Field of the Invention

The present invention relates to a composition which is used directly in the conventional home laundry machine to clean and renourish articles made from leather, textile and synthetic leather.

2. Description of the Prior Art

In the past, faced with the problem of cleaning leather articles, consumer choices were either 1) to send the article to a dry cleaning establishment or 2) to "spot" clean with either detergents formulated for the textile industry, or with harsh solvents which would disrupt the leather finish and remove or dull color.

Typically, dry cleaning establishments use combinations of petroleum distillate solvents to clean these articles. This process is costly and the solvents remove lubrication from deep within the leather leaving leather garments dry, dull and stiff to the touch. Results lead to disappointment when garments appear faded due to removal of the very lubricants which were incorporated in the tanning process itself to create a soft feel with good depth of color.

The tanning process combines an intricate series of stages resulting in soft flexible leather. Hides are deeply scoured and cleaned to remove natural fats and oils permitting further processing. After tanning, the hides are tumbled in drums with emulsions of fat-liquors to thoroughly lubricate the leather fibers and create a suppleness in the hide. Converting leather to usable "fabric" can take months. Yet, without this cleaning and conditioning process, leather does not possess the unique qualities, which make it superior to any man-made material—nor would it be able to be easily "worked" into useful items.

To add a softer, more comfortable hand with increased tensile strength to the hide, the tanner may utilize additional finishing baths.

There are several products, which purport to provide detergent-type cleaning of leather or combination leather/fabric articles:

It is believed that these products are combinations of surfactants, alcohols and raw oils. These components appear to clean the article, but do little to add back conditioning lubricants and properties which truly enhance the characteristics of leather, i.e., flexibility, richness of color, feel, wearability, etc. Continued use of alkaline cleaning products on leather will actually decrease its service life.

One product which claims leather cleaning ability is a blend of coconut oils. The product possesses cleaning properties derived from plant oils and protein extracts without bleach additives—for use on horse blanklets, as well as leather chaps, gloves, etc.

SUMMARY OF THE INVENTION

The present invention replicates the stages of cleaning and conditioning leather as practiced in the tanning process. The invention comprises two compositions which are used during a typical washing cycle in the home washing machine. The leather laundry solution is added during the "wash cycle."

Subsequently a laundry rinse and dressing composition is added to the finishing rinse cycle of the washing machine. The composition may also be used as a wipe-on application after laundering.

The complexities of the washing machine have been conquered by millions of people the world over. People are also familiar with adding detergents and finishing softeners to their laundry machines in order to clean, soften and refresh clothing. Applicant has provided an improvement to the prior art by the introduction of products in combination that can clean and condition leather, leather/fabric, sheepskin and wool fleece combination articles within the home laundry environment.

The two compositions of the present invention which are used in combination are: the leather laundry solution which as noted above is used directly in washing machines to clean and re-nourish leather, textile & synthetic leather combination articles (i.e. leather pants, chaps, equestrian riding britches, gloves, jackets, wool fleece saddle pads and sheepskin articles, such as auto seat covers); and the laundry rinse and dressing composition is used in the "rinise" cycle of washing machines to add a finishing softness to articles washed with leather laundry solution. When the laundry rinse and dressing composition is used as a wipe-on application after laundering, it has been determined that the application of same to the surface of the leather relaxes the leather fiber as it dries.

Heretofore, it was not possible to duplicate the suppleness and hand provided to the leather by the tanning process during a cleaning of the leather. Applicant's improvement in cleaning leather goods by washing and re-conditioning leather in the home laundry with leather laundry solution and laundry rinse and dressing reinstates the desirable properties of leather without having to resort to expensive and environmentally unsound methods. With the composition and method of the present invention items such as full leather pants, jackets, "washable" leather shoes, handbags, etc. can be cleaned and re-conditioned conveniently in the home laundry.

DETAILED DESCRIPTION OF THE PREFERRED EMBODIMENT

The composition of the present invention is an environmentally safe, fat-liquor-based surfactant solution, synergistic to both leather acid fabric. The product effectively cleans, and then provides penetrating and long lasting conditioners to nourish and protect both synthetic and natural fiber.

Leather has an isoelectric point around a pH of 5.2 and in its completed state is typically below a pH of 4. Highly alkaline cleaners (pH over 9) work well for hard surfaces but not for leather. Continued use of high alkalinity will shift the pH higher and allows the lubricating fat-liquor components and dyes to migrate out of the leather. The leather therapy combination of the present invention gives cleaning and lubrication properties without introducing harsh pH changes.

The leather laundry solution is an emulsion that contains a unique combination of "anionic" (strongly negatively charged ions) and "nonionic" (neutral) fatty surfactants and fatty acid esters in a pH balanced (pH 6+/−) formula. The solution has a golden brown appearance with a pleasing odor.

The laundry rinse and dressing solution is a requisite sister product (mildly anionic) which is added to the finishing rinse cycle in the washing machine. It is thought that the leather laundry emulsion allows the strongly negative charged articles in the wash to control deposition of the mildly anionic dressing near the surface, which in turn, imparts a softer hand and better appearance to leather, fabrics and wool fleece.

The emulsions must be of a stable nature for the system to be effective. Anionic charge characteristics, pH of the leather and pH of the emulsions control deposition of the materials. This is for this reason that the combination of both products are not combined into one single washing/conditioning product.

The ideal pH range of the compositions is between 6 & 7. Variability due to water pH is insignificant since components are pH balanced at the manufacturing source and are stable across a wide pH and water hardness range. Percentages for each formula may vary 3 to 6% based on variation of natural ingredients.

The solutions of the present invention were prepared having the following compositions:

EXAMPLE 1

| LEATHER LAUNDRY SOLUTION | | |
|---|---|---|
| 12.8% | Anionic Surfactant | Alkylated diphenyl oxide sulfonate |
| 2.6% | Anionic Surfactant | Alkyl ethoxy sulfate, sodium salt |
| 12.0% | Nonionic Surfactant | Alkyl-phenol ethoxylate |
| 13.6 | Anionic Surfactant | Fatty composition - sodium salt of sulfated blend of fatty alcohols, fatty acids, methyl esters and animal fats |
| 59.0% | Water | |

EXAMPLE 2

| LAUNDRY RINSE & DRESSING | | |
|---|---|---|
| 17.0% | Anionic Soap | Potassium animal fat soap |
| 1.5% | Nonionic Emulsifier | Nonylphenol Ethoxylate |
| 4.0% | Anionic Soap | Potassium fatty acid soap |
| 2.5% | Anionic Fat-liquor | Sodium salt of sulfated animal fat |
| 75.0% | Water | |

It is determined that the specific concentrations given above in Examples 1 and 2 provide the preferred embodiment. It is further determined that the acceptable range of percentages for each constituent in the formulae presented may vary 10% to 20% to ensure compatibility.

Applicant has also determined that an improved product can be formed by combining the above Formulas #1 and #2 and adding shine enhancing components consisting of silicones, waxes or esters. This will be a one-step leather care product, in emulsion form and will be used primarily in the shoe and automobile markets.

The preferred formula is 50% Formula #1 (above), 40% Formula #2 (above), 10% shine enhancing agents.

Thus, while there have been shown, described and pointed out fundamental novel features of the invention as applied to currently preferred embodiments thereof, it will be understood that various omissions and substitutions and changes in the form and details of the method and compositions illustrated, and in their operation, may be made by those skilled in the art without departing from the spirit of the invention. It is the intention, therefore, to be limited only as indicated by the scope of the claims appended herewith

What I claim and desire to protect by Letters Patent is:

1. A composition which is used directly as a leather laundry solution in the conventional home laundry machine in combination to clean and renourish articles comprising:

between about 10.2% and about 15.4% of an anionic surfactant which is alkylated diphenyl oxide sulfonate;

between about 2.1 and about 3.1% of an anionic surfactant which is alkyl ethoxy sulfate, sodium salt;

between about 9.6% and about 14.4% of a nonionic surfactant which is alkyl-phenol ethoxylate;

between about 10.2% and about 15.4% of an anionic surfactant which is a fatty composition blend of sodium salt of sulfated blend of fatty alcohols, fatty acids, methyl esters and animal fats; and the balance of said composition is water;

said article being cleaned and re-nourished in a home laundry machine and being formed from a material selected from the group consisting of leather, synthetic leather, textile, wool, fleece and combinations thereof.

2. A composition which is used directly as a leather laundry rinse and dressing solution in the conventional home laundry machine in combination to clean and renourish articles comprising:

between about 13.6% and 20.4% of an anionic soap which is potassium animal fat soap;

between about 1.2% and about 1.8% of a nonionic emulsifier which is nonylphenol ethoxylate;

between about 3.2% and about 4.8% of an anionic soap which is potassium fatty acid soap;

between about 2.0% and 3.0% of an anionic fat-liquor which is the sodium salt of sulfated animal fat; and, the balance of said composition is water;

said article being cleaned and re-nourished in a home laundry machine and being formed from a material selected from the group consisting of leather, synthetic leather, textile, wool, fleece and combinations thereof.

3. The composition of claim 1, which comprises:

| | | |
|---|---|---|
| 12.8% | Anionic Surfactant | Alkylated diphenyl oxide sulfonate |
| 2.6% | Anionic Surfactant | Alkyl ethoxy sulfate, sodium salt |
| 12.0% | Nonionic Surfactant | Alkyl-phenol ethoxylate |
| 13.6% | Anionic Surfactant | Fatty composition - sodium salt of sulfated blend of fatty alcohols, fatty acids, methyl esters and animal fats |
| 59.0% | Water. | |

4. The composition of claim 2, which comprises:

| | | |
|---|---|---|
| 17.0% | Anionic Soap | Potassium animal fat soap |
| 1.5% | Nonionic Emulsifier | Nonylphenol Ethoxylate |
| 4.0% | Anionic Soap | Potassium fatty acid soap |
| 2.5% | Anionic Fat-liquor | Sodium salt of sulfated animal fat |
| 75.0% | Water. | |

5. A method for cleaning and re-nourishing an article comprising contacting an article formed from a material selected from the group consisting of leather, synthetic leather, textile, wool, fleece and combination thereof, in a conventional home laundry machine during a wash cycle in said machine with a composition in solution comprising:

between about 10.2% and about 15.4% of an anionic surfactant which is alkylated diphenyl oxide sulfonate;

between about 2.1 and about 3.1% of an anionic surfactant which is alkyl ethoxy sulfate, sodium salt;

between about 9.6% and about 14.4% of a nonionic surfactant which is alkyl-phenol ethoxylate;

between about 10.2% and about 15.4% of an anionic surfactant which is a fatty composition blend of sodium salt of sulfated blend of fatty alcohols, fatty acids, methyl esters and animal fats;

the balance of said composition is water;

and then contacting said article during a rinse cycle in said machine with a composition in solution comprising:

between about 13.6% and 20.4% of an anionic soap which is potassium animal fat soap;

between about 1.2% and about 1.8% of a nonionic emulsifier which is nonylphenol ethoxylate;

between about 3.2% and about 4.8% of an anionic soap which is potassium fatty acid soap;

between about 2.0% and 3.0% of an anionic fat-liquor which is the sodium salt of sulfated animal fat;

the balance of said composition is water;

drying said article.

6. The method defined in claim 5 wherein said wash cycle composition is:

| | | |
|---|---|---|
| 12.8% | Anionic Surfactant | Alkylated diphenyl oxide sulfonate |
| 2.6% | Anionic Surfactant | Alkyl ethoxy sulfate, sodium salt |
| 12.0% | Nonionic Surfactant | Alkyl-phenol ethoxylate |
| 13.6% | Anionic Surfactant | Fatty composition - sodium salt of sulfated blend of fatty alcohols, fatty acids, methyl esters and animal fats |
| 59.0% | Water; | |

and said rinse cycle solution is:

| | | |
|---|---|---|
| 17.0% | Anionic Soap | Potassium animal fat soap |
| 1.5% | Nonionic Emulsifier | Nonylphenol Ethoxylate |
| 4.0% | Anionic Soap | Potassium fatty acid soap |
| 2.5% | Anionic Fat-liquor | Sodium salt of sulfated animal fat |
| 75.0% | Water | |

said articles being cleaned and re-nourished in a home laundry machine and formed from a material selected from the group consisting of leather, synthetic leather, textile, wool, fleece and combinations thereof.

7. The method defined in claim 6, wherein said article is formed from leather.

8. The method defined in claim 6, wherein said article is formed from synthetic leather fabric.

9. The method defined in claim 6, wherein said article is formed from sheepskin.

10. The method defined in claim 6, wherein said article is formed from wool/fleece combination.

11. The method defined in claim 6, wherein said article is formed from wool.

12. The composition defined in claim 1 which also contains shine enhancing components selected from the group consisting of silicon compounds, wax and ester-containing compounds.

13. The composition defined in claim 2 which also contains shine enhancing components selected from the group consisting of silicon compounds, wax and ester-containing compounds.

14. The method defined in claim 5 which also contains shine enhancing components selected from the group consisting of silicon compounds, wax and ester-containing compounds.

* * * * *